US008959967B1

(12) United States Patent
Hamburgen et al.

(10) Patent No.: US 8,959,967 B1
(45) Date of Patent: Feb. 24, 2015

(54) CONTROLLED FLATTENING OF SHEET MATERIALS

(71) Applicant: Google Inc., Mountain View, CA (US)

(72) Inventors: William Hamburgen, Palo Alto, CA (US); Michael John Bliss, Santa Clara, CA (US)

(73) Assignee: Google Inc., Mountain View, CA (US)

( * ) Notice: Subject to any disclaimer, the term of this patent is extended or adjusted under 35 U.S.C. 154(b) by 146 days.

(21) Appl. No.: 13/841,483

(22) Filed: Mar. 15, 2013

(51) Int. Cl.
*B21D 37/10* (2006.01)
*B21D 1/00* (2006.01)

(52) U.S. Cl.
CPC ..... *B21D 1/00* (2013.01)
USPC ..... 72/9.1; 72/11.7; 72/53; 72/199; 72/365.2; 72/379.2

(58) Field of Classification Search
USPC ..... 72/7.1, 9.1, 11.7, 53, 153, 199, 201, 72/365.2, 389.1, 389.3
See application file for complete search history.

(56) References Cited

U.S. PATENT DOCUMENTS

| | | | | |
|---|---|---|---|---|
| 3,850,024 | A * | 11/1974 | Ando et al. | 73/37.7 |
| 3,990,284 | A * | 11/1976 | Barten | 72/8.5 |
| 6,513,358 | B2 * | 2/2003 | Jonsson et al. | 72/9.1 |
| 8,434,340 | B2 * | 5/2013 | Cunha et al. | 72/336 |
| 8,634,953 | B2 * | 1/2014 | Soderlund | 148/559 |

* cited by examiner

*Primary Examiner* — David B Jones
(74) *Attorney, Agent, or Firm* — Brake Hughes Bellermann LLP

(57) ABSTRACT

Controlling a flatness of a first surface of a sheet material can include: (a) determining a first surface contour of the first surface of the sheet; (b) applying compressive stresses to one or more portions of the first surface of the sheet after the determination of the first surface contour of the sheet; (c) annealing compressive stresses in one or more portions of the first surface of the sheet after the determination of the first surface contour of the sheet; (d) determining a second surface contour of the first surface of the sheet after the compressive stresses have been applied to, and annealed from, the sheet; (e) comparing the second surface contour to a threshold flatness; and (f) performing (b)-(e) one or more times until the determined second surface contour is less than the threshold flatness.

20 Claims, 5 Drawing Sheets

CONTROLLED FLATTENING OF SHEET MATERIALS

TECHNICAL FIELD

This description relates to preparation of sheet materials and, in particular, to controlled flattening of sheet materials.

BACKGROUND

Sheet metal is used in a wide variety of applications. In many applications, it is desirable that the sheet metal have a flatness that is within a specified tolerance. Often, it can be a challenge to achieve a high degree of flatness for a part of sheet metal without resorting to the use of complicated and expensive equipment.

SUMMARY

In a first general aspect, a method for controlling a flatness of a first surface of a sheet material includes: (a) determining a first surface contour of the first surface of the sheet; (b) applying compressive stresses to one or more portions of the first surface of the sheet after the determination of the first surface contour of the sheet; (c) annealing compressive stresses in one or more portions of the first surface of the sheet after the determination of the first surface contour of the sheet; (d) determining a second surface contour of the first surface of the sheet after the compressive stresses have been applied to, and annealed from, the sheet; (e) comparing the second surface contour to a threshold flatness; and (f) performing (b)-(e) one or more times until the determined second surface contour is less than the threshold flatness.

Implementations can include one or more of the following features. For example, determining the second flatness of the sheet can include reflecting a radiation beam off the sheet and comparing a property of the reflected beam to an expected property of the reflected beam. Determining the second flatness of the sheet can include reflecting a radiation beam off the sheet and comparing a property of the reflected beam to a reference radiation beam. Determining the second flatness of the sheet can include scanning a mechanical probe over the first surface of the sheet.

The sheet can include metal Annealing compressive stresses in the one or more portions of the sheet can include shining a laser on the one or more portions of the sheet Annealing compressive stresses in the one or more portions of the sheet can include shining a laser on the one or more portions of the sheet and controlling the power of the laser and the duration of the time the laser is shined on the one or more portions such that compressive stresses are not annealed by the laser on a second surface of the sheet, wherein the second surface is parallel to the first surface of the sheet.

An area of the first surface can be greater than 30 $in^2$, and the sheet can have a substantially uniform thickness of less than 2 mm, and the threshold flatness can be less than or equal to ±0.4 mm. A second surface of the sheet that is parallel to the first surface can have a flatness that is greater than ±0.8 mm after (f). At least some of the portions in which compressive stresses are annealed can overlap at least some of the portions in which compressive stresses are applied.

Performing (b)-(e) one or more times until the determined second flatness is less than the threshold flatness can include performing (b) and (c) a different number of times. Applying compressive stresses to one or more portions of the first surface of the sheet can include particle blasting the one or more portions of the first surface. Applying compressive stresses to one or more portions of the first surface of the sheet can include particle blasting one or more portions of a second surface of the sheet, and the second surface of the sheet can be parallel to the first surface and the one or more portions of the second surface that are particle blasted can be located opposite the one or more portions of the first surface to which the compressive stresses are applied.

In another general aspect, a method for controlling a flatness of a first surface of a sheet material includes: (a) determining a first surface contour over a plurality of areas of the first surface of the sheet; (b) applying compressive stresses to one or more portions of each of the plurality of areas of the first surface of the sheet after the determination of each of the first surface contour of the sheet; (c) annealing compressive stresses in one or more portions of each of the plurality of areas of the first surface of the sheet after the determination of the first surface contour of the sheet; (d) determining a second surface contour over each of the plurality of areas of the first surface of the sheet after the compressive stresses have been applied to, and annealed from, each of the plurality of areas of the sheet; (e) comparing the second surface contours to a threshold flatness; and (f) performing (b)-(e) one or more times until the determined second surface contours are less than the threshold flatness.

Implementations can include one or more of the following features. For example, the sheet can include metal. The sheet can be rolled into roll after (f). Each of the plurality of areas can correspond to an area of a subsheet to be formed from the sheet. Annealing compressive stresses in the one or more portions of each of the plurality of areas of the first surface of the sheet can include shining a laser on the one or more portions of each of the plurality of areas of the first surface of the sheet. The sheet can include metal, and each of the plurality of areas of the first surface of the sheet can be greater than 30 $in^2$, where the sheet has a substantially uniform thickness of less than 2 mm, and where the threshold flatness can be less than or equal to ±0.4 mm. At least some of the portions in which compressive stresses are annealed can overlap at least some of the portions in which compressive stresses are applied.

The details of one or more implementations are set forth in the accompanying drawings and the description below. Other features will be apparent from the description and drawings, and from the claims.

BRIEF DESCRIPTION OF THE DRAWINGS

Like reference symbols in the various drawings indicate like elements.

DETAILED DESCRIPTION

As described herein, a sheet of material having an uneven or an unflat surface can have its surface flattened by locally applying compressive stresses to, and locally annealing compressive stresses from, subregions of the surface. The flatness of the surface can be measured, and high and low spots of the surface can be treated by adding or removing compressive stresses from the high and low spots to flatten the surface. Then, the surface can be measured again, and high and low spots of the surface can again be treated by adding or removing compressive stresses to flatten the surface. This process can be iterated multiple times until the surface of the sheet of material achieves a desired flatness.

Figure 1:
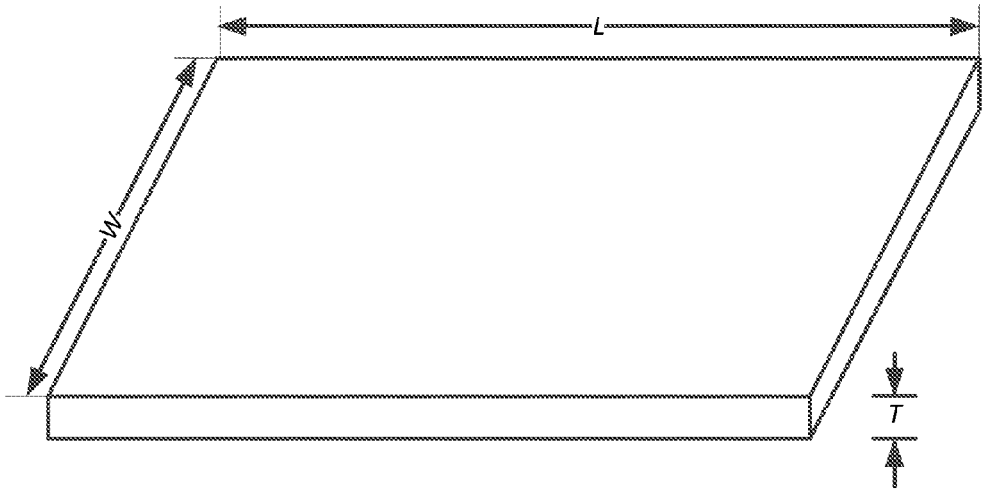
FIG. 1 is a schematic perspective view of a sheet of material.

FIG. 1 is a schematic perspective view of a sheet of material 100. The sheet 100 can include a variety of materials, including, for example, stainless steel, aluminum, copper, metallic alloys, etc. The sheet of material 100 can have a length, L, a width, W, and the thickness, T. An area, A, of a surface of the sheet of material 100 can be defined by A=L×W. In some implementations, the sheet of material 100 can be used in a consumer electronics product, for example, a notebook computer, a tablet computer, a mobile phone, etc. For example, the sheet of material 100 can form one of the external walls of a consumer electronics product. When used as an external wall of a mobile phone, the sheet of material 100 can have an area that is greater than about 6 $in^2$ and can have a thickness that is less than about 2 mm. When used as an external wall of a tablet computer or a notebook computer, the sheet of material 100 can have an area that is greater than about 30 $in^2$ and the thickness that is less than about 2 mm. In some implementations, the flatness of the surface of the sheet of material 100 can be an important property when the sheet of material is used in a product. For example, a sheet of material that has a high degree of flatness can be desirable to provide a surface that is appealing to a user, so that the surface does not appear wavy or bumpy.

Figure 2:
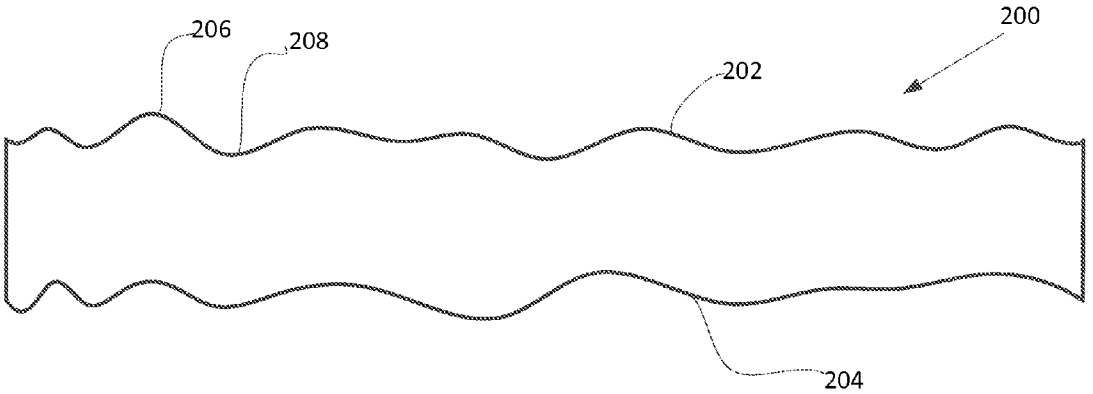
FIG. 2 is a schematic cross-sectional view of a sheet of material having an uneven surface.

FIG. 2 is a schematic cross-sectional view of a sheet of material 200 having an uneven surface. The sheet of material 200 can have a top surface 202 and a bottom surface 204. The top surface 202 can include one or more bumps 206 that protrude in a direction perpendicular to the surface 202 above an average height of the surface, and the surface 202 can include one or more indentations 208 that extend below the average height of the surface. A flatness of a nominally planar surface 202 can be defined in terms of a difference between a maximum height of a point on the surface 206 and a minimum height of a point on the surface 208. In other implementations, surfaces that are not nominally planar (e.g., a paraboloid), but rather are intended to have a predetermined curvature, the flatness of the surface can be defined in terms of a difference between a maximum vertical deviation of a point on the surface from a designed vertical position of the point and a minimum vertical deviation of a point on the surface from a designed vertical position of the point.

Figure 3:
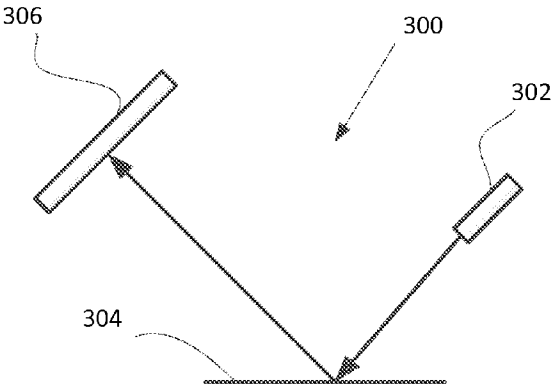
FIG. 3 is a schematic diagram illustrating a method of determining a surface profile of a sheet of material.

FIG. 3 is a schematic diagram illustrating an example system 300 for determining a surface profile of a sheet of material. The system 300 includes a light source 302 (e.g., a laser) that is shined onto a small region of the sheet of material 304. Light reflected from the sheet of material is directed towards a position-sensitive detector 306, which records the position of the reflected light on the detector. The position at which light from the light source 302 strikes the sheet of material 304 can be scanned over the entire surface of the sheet of material while the reflected light is recorded on the position-sensitive detector 306. By knowing the direction in which the light from the light source 302 is shined and the position on the detector 306 of the reflected light, a surface contour of the sheet of material 304 can be determined.

The surface contour of the sheet of material 304 can be a list or array of data points giving the height of the surface at particular coordinates of the surface of the sheet of material. For example, the coordinates of the surface of the sheet of material can be given by (x, y) values, where the variables x, y correspond to positions along the length and width, respectively, of the sheet of material 304. Then, the surface contour can be given by a list or array of data points z(x, y), where z is the height of the surface at a particular (x, y) coordinate on the surface of the sheet of material.

Figure 4:
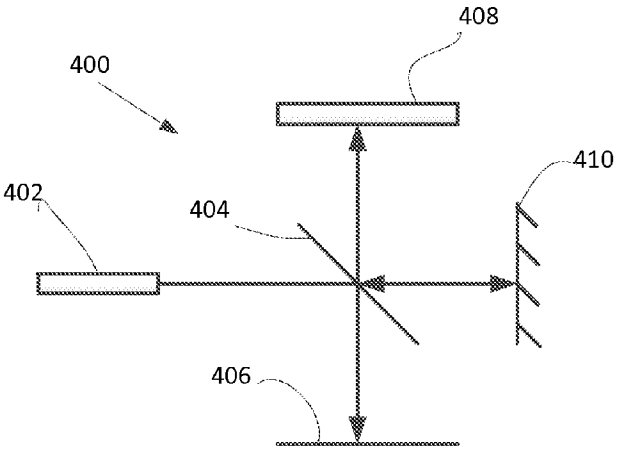
FIG. 4 is another schematic diagram illustrating another method of determining a surface profile of a sheet of material.

FIG. 4 is another schematic diagram illustrating another example system 400 for determining a surface profile of a sheet of material. The system 400 uses interference techniques to determine a surface contour of a surface of a sheet of material 406. The system 400 illustrates one particular implementation of a system that applies interference techniques to determine the surface contour, but other systems and techniques are also possible.

In the implementation shown in FIG. 4, the system 400 includes a coherent light source (e.g., a laser) 402 that shines light towards a beam splitter 404. In some implementations, the beam splitter 404 can include a partially silvered mirror. The beam splitter 404 directs part of the beam from the light source 402 toward a surface of the sheet of material 406, and the surface reflects the light back up through the beam splitter 404 and onto a position sensitive detector 408. The beam splitter 404 also allows a portion of the beam from the coherent light source 402 to pass through the beam splitter and to reflect off of a mirror 410. This reflected beam returns to the beam splitter 404, where is reflected toward the detector 408. The two beams interfere with each other, and the interference pattern between the two beams is recorded by the detector 408. Because the phase of the interference pattern depends on the distance traveled by the beam that is reflected off of the surface of the sheet of material 406, the interference pattern provides information about the local height of particular locations on the surface of the sheet of material 406. In this manner, a surface contour of the sheet of material 406 can be determined. Once a surface contour for a sheet of material has been determined, high spots on the surface can be annealed and compressive stresses can be introduced to low spots in the surface, so that the surface can be flattened.

In other implementations, a surface contour of a sheet of material can be measured by a mechanical probe that is scanned over the surface. As the mechanical probe is scanned over the surface, its displacement in the vertical direction, perpendicular to the surface, can be recorded as a function of the x, y position of the probe.

Figure 5:
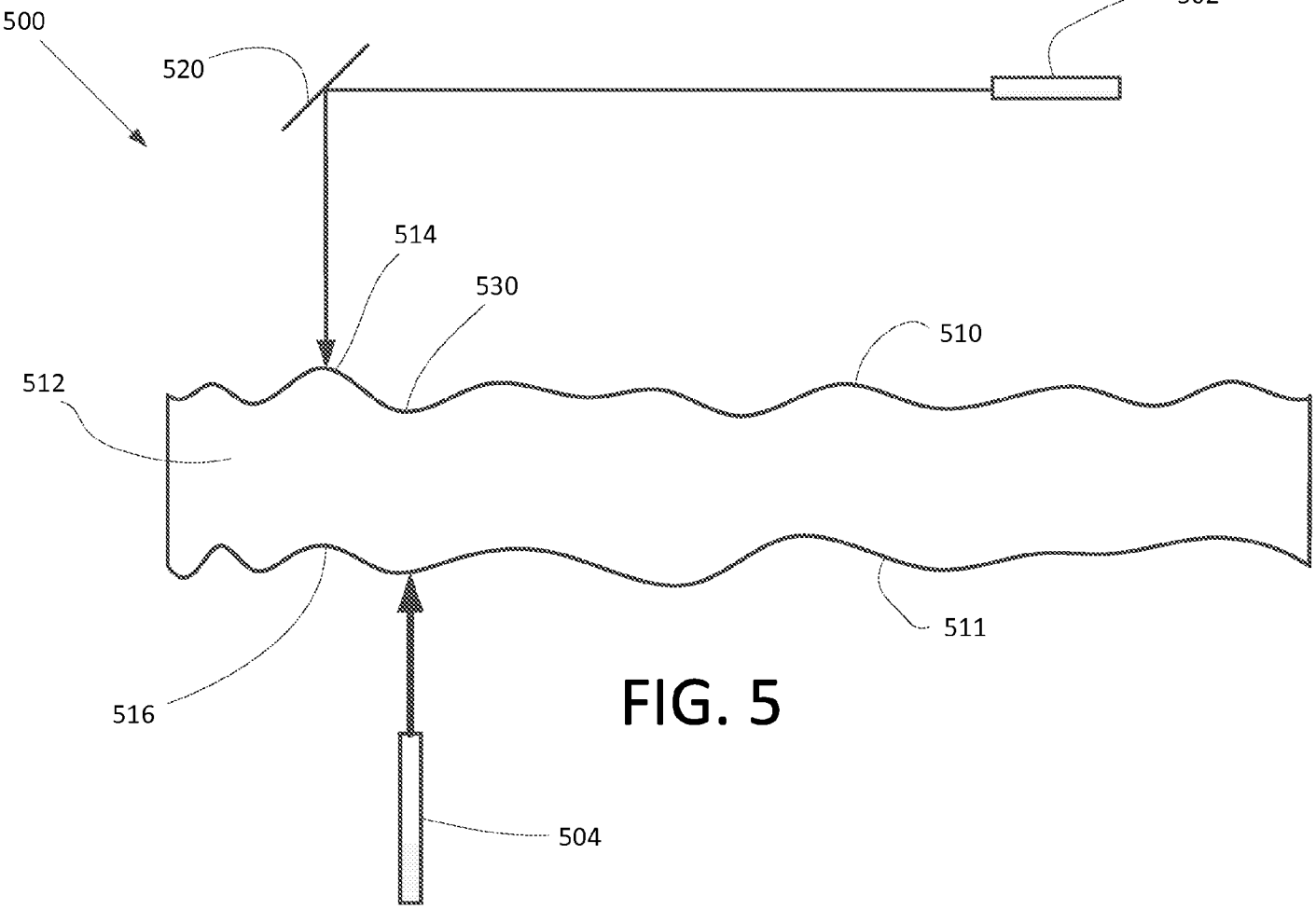
FIG. 5 is a schematic diagram of a system for flattening a surface of a sheet of material.

FIG. 5 is a schematic diagram of a system 500 for flattening a surface 510 of a sheet of material 512. The system can include a device 502 that anneals existing compressive stresses in local portions of the surface of the sheet of material and a device 504 that applies compressive stresses to one or more portions of the surface of the sheet of material. The existing compressive stresses can be residual stresses from a process that forms the sheet or can be stresses that are introduced to the sheet. In some implementations, the device 502 can include a laser (e.g., a $CO_2$ laser) that can apply a controlled amount of energy for a controlled amount of time to particular portions of the surface of the sheet of material. In some implementations, the device 502 can include a flash lamp that applies a controlled amount of energy for a controlled amount of time to particular portions of the surface of the sheet of material.

In implementations where the device 502 includes a laser or a flash lamp, light from the laser or the flash lamp can be delivered to different portions of the surface 510 of the sheet of material 512 by using one or more scanning optical elements 520 to deliver the light to different portions of the surface 510. The intensity of the light beam that is delivered to the surface and/or the duration of the time the light beam is delivered can be controlled with appropriate control of the device 502 and/or the optical elements 520.

Parameters of the light beam that is provided to the surface 510 of the sheet of material 512 can be controlled to anneal bumps that protrude above the average height of the surface 510 such that the height of the bumps can be reduced. For example, one or more of the position of the light beam, the intensity of the light beam, the cross-sectional intensity profile of the light beam, and the duration of the light beam can be controlled to anneal protrusions on the surface 510 as desired. In some implementations, when a laser beam is used to anneal a generally circularly symmetric protrusion on the surface 510, the laser beam can be scanned in concentric circles around the apex of the protrusion. In some implementations, when a laser beam is used to anneal a generally circularly symmetric protrusion on the surface, the laser beam can be scanned in radial directions from the apex of the protrusion. In some implementations, a combination of circular scans and radial scans can be used to anneal the protrusion. The laser beam can be scanned over and/or around the protrusion a plurality of times, with each scan annealing a bit more of the compressive stresses in the protrusion. When a protrusion that is to be annealed is not circularly symmetric, then appropriate scan directions of the light beam can be selected to anneal the protrusion and reduce its height above the surface 510. Parameters of the light beam that is provided to the surface 510 of the sheet of material can be computer-controlled in response to the surface contour that is determined for the surface 510, so that protrusions on the surface are lowered but other portions of the surface are not affected.

When annealing a protrusion on a surface 510 of the sheet of material 512, a laser beam can be applied directly to the protrusion itself 514. In another implementation, the laser beam can be applied to a position 516 on an opposite surface 511 of the sheet of material 512. The position 516 can be directly opposite the protrusion whose height is to be reduced on the surface 511 that is parallel to the surface 510 that is to be flattened. Although the effect of applying the annealing to the opposite surface 511 of the surface to be flattened 510 can be attenuated compared to applying the annealing directly to the surface 510, providing the annealing to the opposite surface 511 can be useful in some implementations so as to reduce cosmetic effects on the surface 510.

Compressive stresses can be applied to low spots 530 on the surface 510 to increase the height of the low spots and thereby further flatten the surface 510 of the sheet of material 512. In some implementations, the device 504 that applies the compressive stresses to the surface 510 can include a particle-blasting device that propels small mechanical particles to a particular portion of the sheet of material 512. The term "particle-blasting" is used herein to refer to various forms of shooting particles at a sheet of material, including, for example, sandblasting, shot lasting, bead blasting, grit blasting, etc. A particle-blasting device 504 can blow a fluid stream that contains small particles through a nozzle toward particular portions of the sheet of material 512, which correspond to those spots on the surface 510 to which compressive stresses are to be added in order to increase the height of the surface at those spots.

Similar to the process described above for annealing protrusions on the surface 510, compressive stresses can be added to particular portions of the surface 510 by the device 504 to increase the height of particular portions while leaving other portions of the surface unaffected. Parameters of the particle beam (e.g., intensity, cross-sectional profile, duration) that is provided to the surface 510 of the sheet of material can be computer-controlled in response to the surface contour that is determined for the surface 510, so that low spots on the surface are raised but other portions of the surface are not affected. The particle beam can be applied directly to the low spots 530 on the surface 510, or, in other implementations, the particle beam can be applied to positions on the opposite surface 511 that correspond to low spots 530 on the surface to be flattened 510.

Besides use of particle beams, other mechanisms for applying compressive stresses to the surface 510 also can be used. For example, an array of mini peening hammers can be used to apply compressive stresses. In another implementation, one or more laser beams can be used to peen the surface to introduce surface stress to the surface 510. A pulsed laser having high instantaneous power (e.g., tens of hundreds of Joules in a pulse having a duration of a few nanoseconds) can be applied to the surface, and each pulse can provide a compressive shock wave to the surface, which introduces stresses to the surface. Prior to laser peening, the surface can be plated with an opaque layer of black paint, metal foil or tape, and the black layer can be covered with a transparent overlay (e.g., flowing water). The material of the black layer can have a low heat of vaporization, such that when the laser strikes the workpiece surface, the energy of the laser pulse is absorbed by the opaque material, which heats up, vaporizes and forms a high temperature plasma. The plasma gas can be trapped between the workpiece surface and the transparent water layer limiting the thermal expansion of the gas. As a result the gas pressure can increases to high value, which transmits pressure to the workpiece material producing a shock wave, which travels through the part material and generates compression stress.

Figure 6:
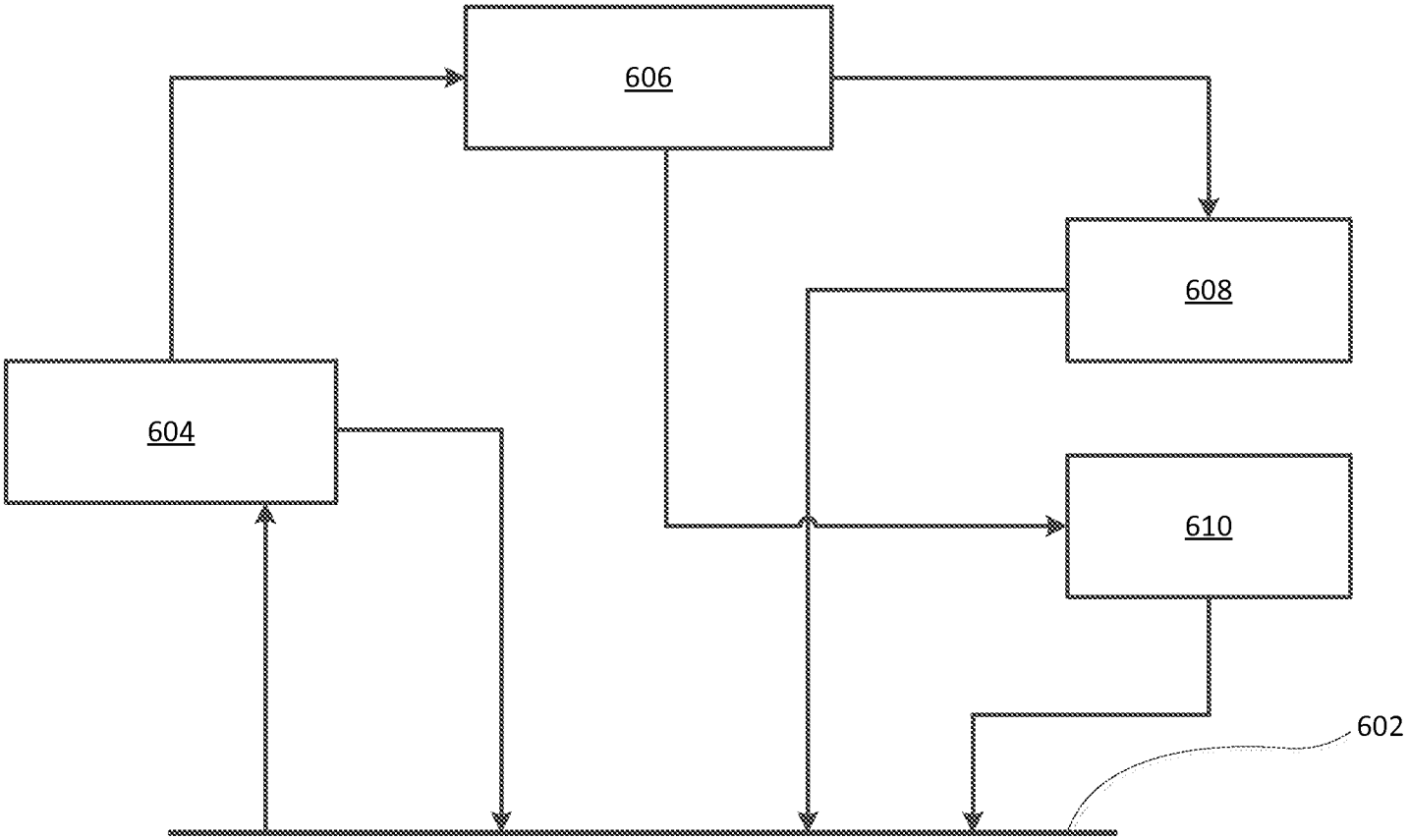
FIG. 6 is a schematic diagram of a system for automatically flattening a surface of a sheet of material.

FIG. 6 is a schematic diagram of a system 600 for automatically flattening a surface of a sheet of material 602. The system 600 includes a surface contour measuring system 604 that measures the surface contour of the sheet of material 602. The measuring system 604 can use optical and/or mechanical techniques to measure the surface contour of the sheet of material 602. Information about the surface contour can be provided to the computerized controller 606 that controls parameters of an annealing device 608 that removes compressive stresses from particular regions of the sheet of material 602 and that controls parameters of a device 610 that applies compressive stresses to particular regions of the sheet of material 602. In response to input from the computerized controller 606, the devices 608 and 610 can anneal compressive stresses from, and add compressive stresses to, respectively, the surface of the sheet of material 602 to flatten the sheet of material.

After a first round of adding compressive stresses to regions of the surface and/or annealing compressive stresses from regions of the surface, the measuring system 604 can again measure a surface contour of the sheet of material 602. Then, in response to the subsequently measured surface contour, the computerized controller 606 can provide new inputs to the devices 608 and 610, so that the devices can provide another round of adding compressive stresses to regions of the surface and/or annealing compressive stresses from regions of the surface. This process can continue to be iterated until the flatness of the surface is within a predetermined tolerance. For example, the process can be iterated until the flatness of the surface is less than ±0.8 mm—that is, until the highest protrusion from the surface is less than 0.8 mm above the average height of the surface, and the lowest depression into the surface is less than 0.8 mm below the average height of the surface. In some implementations, the process can be iterated until the flatness of the surface is less than ±0.4.

In some implementations, portions of the sheet to which compressive stresses are applied can overlap with, or correspond to, portions of the sheet from which compressive stresses are annealed. For example, in some implementations, a portion of the sheet may have compressive stresses annealed from it and then have compressive stresses added back to it, so that the overall flatness of the sheet is improved. In some implementations, during the iterative process described above, the process of annealing compressive stresses from particular areas of the sheet can be performed a different number of times then the process of applying compressive stresses to particular areas of the sheet.

Figure 7:
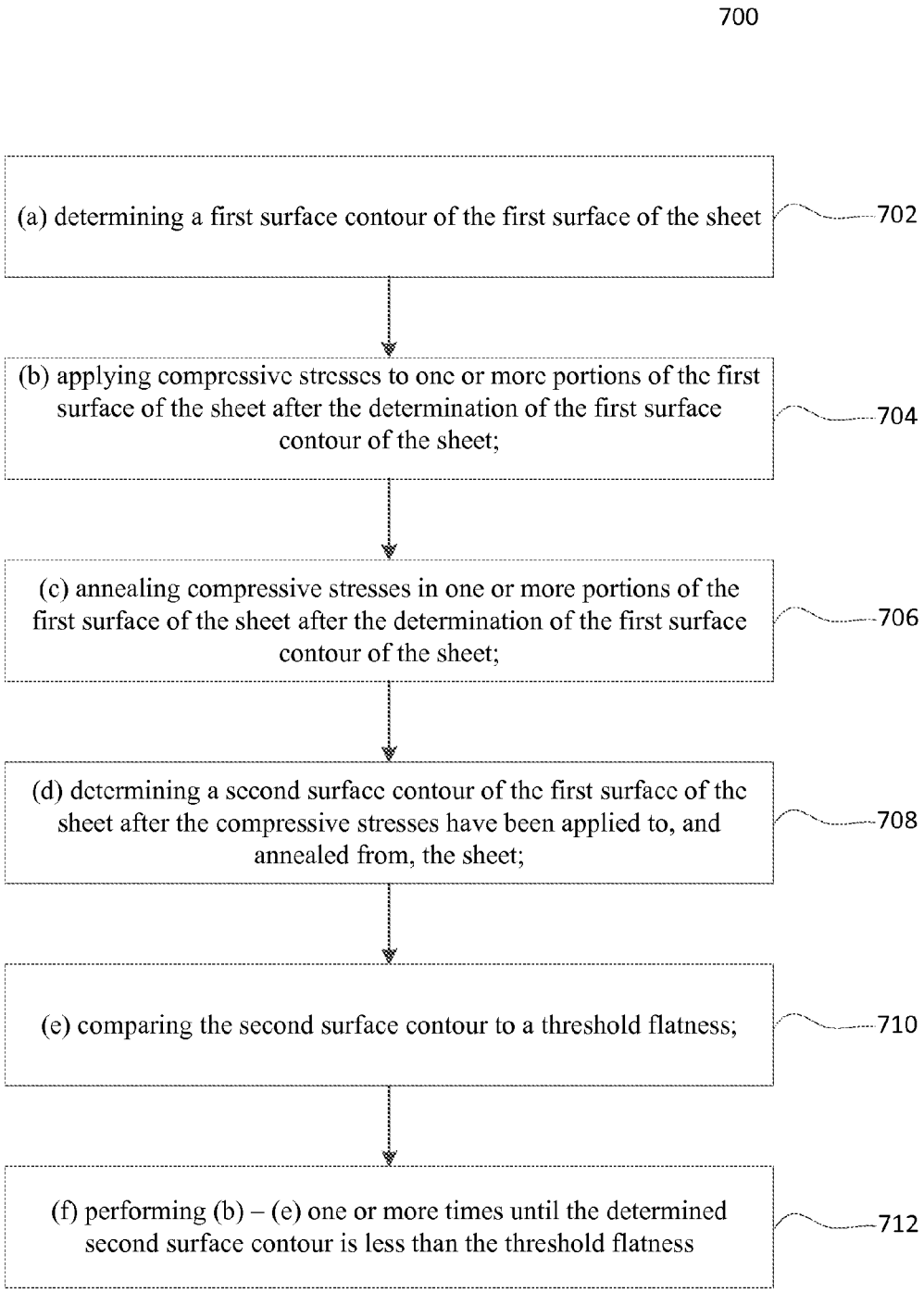
FIG. 7 is a flowchart of a process for flattening a sheet of material.

FIG. 7 is a flowchart of a process 700 for flattening a sheet of material. The process includes determining a first surface contour of the first surface of the sheet (702). Compressive stresses can be applied to one or more portions of the first surface of the sheet after the determination of the first surface contour of the sheet (704). Compressive stresses can be annealed in one or more portions of the first surface of the sheet after the determination of the first surface contour of the sheet (706). A second surface contour of the first surface of the sheet can be determined after the compressive stresses have been applied to, and annealed from, the sheet (708). The second surface contour can be compared to a threshold flatness (710). Steps 704, 706, 708, 710 can be repeated one or more times until the determined second surface contour is less than the threshold flatness.

In some implementations, a sheet of material can have a plurality of areas over which a surface contour is measured, and which are flattened using an iterative process of annealing compressive stresses in protrusions of the areas and adding compressive stresses to depressions within the areas, re-measuring surface contours for the areas, and they can applying compressive stresses to depressions and annealing compressive stresses within protrusions. For example, a roll of material might be used for a plurality of parts, which can be formed from the roll of material (e.g. by a cutting or stamping process). Individual surface areas of the roll of material that correspond to the plurality of parts that will be formed from the material can be flattened while the material is still part of a continuous sheet, although in a completely- or semi-unrolled form, and the individual parts can be formed from the role of material in a later processing step. In some implementations, after flattening the different regions of the continuous sheet, the sheet can be rolled into a roll format to facilitate transportation before different sub sheets are formed from the roll.

Implementations of the various techniques described herein may be implemented in digital electronic circuitry, or in computer hardware, firmware, software, or in combinations of them. Implementations may implemented as a computer program product, i.e., a computer program tangibly embodied in an information carrier, e.g., in a machine-readable storage device, for execution by, or to control the operation of, data processing apparatus, e.g., a programmable processor, a computer, or multiple computers. A computer program, such as the computer program(s) described above, can be written in any form of programming language, including compiled or interpreted languages, and can be deployed in any form, including as a stand-alone program or as a module, component, subroutine, or other unit suitable for use in a computing environment.

The computerized control of the devices described herein may be performed by one or more programmable processors executing a computer program to perform functions by operating on input data and generating output. Method steps also may be performed by, and an apparatus may be implemented as, special purpose logic circuitry, e.g., an FPGA (field programmable gate array) or an ASIC (application-specific integrated circuit).

Processors suitable for the execution of a computer program include, by way of example, both general and special purpose microprocessors, and any one or more processors of any kind of digital computer. Generally, a processor will receive instructions and data from a read-only memory or a random access memory or both. Elements of a computer may include at least one processor for executing instructions and one or more memory devices for storing instructions and data. Generally, a computer also may include, or be operatively coupled to receive data from or transfer data to, or both, one or more mass storage devices for storing data, e.g., magnetic, magneto-optical disks, or optical disks. Information carriers suitable for embodying computer program instructions and data include all forms of non-volatile memory, including by way of example semiconductor memory devices, e.g., EPROM, EEPROM, and flash memory devices; magnetic disks, e.g., internal hard disks or removable disks; magneto-optical disks; and CD-ROM and DVD-ROM disks. The processor and the memory may be supplemented by, or incorporated in special purpose logic circuitry.

A number of implementations have been described. Nevertheless, it will be understood that various modifications may be made without departing from the spirit and scope of the invention.

In addition, the logic flows depicted in the figures do not require the particular order shown, or sequential order, to achieve desirable results. In addition, other steps may be provided, or steps may be eliminated, from the described flows, and other components may be added to, or removed from, the described systems. Accordingly, other implementations are within the scope of the following claims.

What is claimed is:

1. A method for controlling a flatness of a first surface of a sheet material, the method comprising:

(a) determining a first surface contour of the first surface of the sheet;

(b) applying compressive stresses to one or more portions of the first surface of the sheet after the determination of the first surface contour of the sheet;

(c) annealing compressive stresses in one or more portions of the first surface of the sheet after the determination of the first surface contour of the sheet;

(d) determining a second surface contour of the first surface of the sheet after the compressive stresses have been applied to, and annealed from, the sheet;

(e) comparing the second surface contour to a threshold flatness; and (f) performing (b)-(e) one or more times until the determined second surface contour is less than the threshold flatness.

2. The method of claim 1, wherein determining the second flatness of the sheet includes reflecting a radiation beam off the sheet and comparing a property of the reflected beam to an expected property of the reflected beam.

3. The method of claim 1, wherein determining the second flatness of the sheet includes reflecting a radiation beam off the sheet and comparing a property of the reflected beam to a reference radiation beam.

4. The method of claim 1, wherein determining the second flatness of the sheet includes scanning a mechanical probe over the first surface of the sheet.

5. The method of claim 1, wherein the sheet comprises metal.

6. The method of claim 1, wherein annealing compressive stresses in the one or more portions of the sheet includes shining a laser on the one or more portions of the sheet.

7. The method of claim 1, wherein annealing compressive stresses in the one or more portions of the sheet includes shining a laser on the one or more portions of the sheet and controlling the power of the laser and the duration of the time the laser is shined on the one or more portions such that compressive stresses are not annealed by the laser on a second surface of the sheet, wherein the second surface is parallel to the first surface of the sheet.

8. The method of claim 1, wherein an area of the first surface is greater than 30 $in^2$, wherein the sheet comprises metal, wherein the sheet has a substantially uniform thickness of less than 2 mm, and wherein the threshold flatness is less than or equal to ±0.4 mm.

9. The method of claim 8, wherein a second surface of the sheet that is parallel to the first surface has a flatness that is greater than ±0.8 mm after (f).

10. The method of claim 1, wherein at least some of the portions in which compressive stresses are annealed overlap at least some of the portions in which compressive stresses are applied.

11. The method of claim 1, wherein performing (b)-(e) one or more times until the determined second flatness is less than the threshold flatness includes performing (b) and (c) a different number of times.

12. The method of claim 1, wherein applying compressive stresses to one or more portions of the first surface of the sheet includes particle blasting the one or more portions of the first surface.

13. The method of claim 1, wherein applying compressive stresses to one or more portions of the first surface of the sheet includes particle blasting one or more portions of a second surface of the sheet, wherein the second surface of the sheet is parallel to the first surface and wherein the one or more portions of the second surface that are particle blasted are located opposite the one or more portions of the first surface to which the compressive stresses are applied.

14. A method for controlling a flatness of a first surface of a sheet material, the method comprising:

(a) determining a first surface contour over a plurality of areas of the first surface of the sheet;

(b) applying compressive stresses to one or more portions of each of the plurality of areas of the first surface of the sheet after the determination of each of the first surface contour of the sheet;

(c) annealing compressive stresses in one or more portions of each of the plurality of areas of the first surface of the sheet after the determination of the first surface contour of the sheet; and (d) determining a second surface contour over each of the plurality of areas of the first surface of the sheet after the compressive stresses have been applied to, and annealed from, each of the plurality of areas of the sheet;

(e) comparing the second surface contours to a threshold flatness;

(f) performing (b)-(e) one or more times until the determined second surface contours are less than the threshold flatness.

15. The method of claim 14, further comprising rolling the sheet into roll after (f).

16. The method of claim 14, wherein each of the plurality of areas corresponds to an area of a subsheet to be formed from the sheet.

17. The method of claim 14, wherein the sheet comprises metal.

18. The method of claim 14, wherein annealing compressive stresses in the one or more portions of each of the plurality of areas of the first surface of the sheet includes shining a laser on the one or more portions of each of the plurality of areas of the first surface of the sheet.

19. The method of claim 14, wherein each of the plurality of areas of the first surface of the sheet is greater than 30 $in^2$, wherein the sheet comprises metal, wherein the sheet has a substantially uniform thickness of less than 2 mm, and wherein the threshold flatness is less than or equal to ±0.4 mm.

20. The method of claim 14, wherein at least some of the portions in which compressive stresses are annealed overlap at least some of the portions in which compressive stresses are applied.

* * * * *